US010807010B2

(12) United States Patent
Hall et al.

(10) Patent No.: US 10,807,010 B2
(45) Date of Patent: Oct. 20, 2020

(54) CONVEYOR RIDE SYSTEM

(71) Applicant: Universal City Studios LLC, Universal City, CA (US)

(72) Inventors: Gregory S. Hall, Orlando, FL (US); Keith Michael McVeen, Winter Garden, FL (US); Michael Joseph Tresaugue, Windermere, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/714,333

(22) Filed: Dec. 13, 2019

(65) Prior Publication Data

US 2020/0215444 A1 Jul. 9, 2020

Related U.S. Application Data

(60) Provisional application No. 62/789,045, filed on Jan. 7, 2019.

(51) Int. Cl.

| | |
|---|---|
| ***A63G 31/10*** | (2006.01) |
| ***A63G 31/08*** | (2006.01) |
| ***A63G 21/04*** | (2006.01) |

(52) U.S. Cl.

CPC ..... *A63G 31/10* (2013.01); *A63G 21/04* (2013.01); *A63G 31/08* (2013.01)

(58) Field of Classification Search

CPC ..... A63G 31/10; A63G 21/04; A63G 31/08; A63G 21/20; A63G 7/00; A63G 31/16; A63G 31/02

See application file for complete search history.

(56) References Cited

U.S. PATENT DOCUMENTS

| | | | | |
|---|---|---|---|---|
| 4,973,042 | A | 11/1990 | Klopf et al. | |
| 5,628,690 | A | 5/1997 | Spieldiener et al. | |
| 5,957,778 | A | 9/1999 | Larson | |
| 6,315,674 | B1 * | 11/2001 | Slade | A63G 31/00 472/131 |
| 6,629,895 | B2 * | 10/2003 | Uemura | A63G 31/16 472/131 |
| 6,755,749 | B2 | 6/2004 | Stengel | |
| 7,922,594 | B2 | 4/2011 | Vert et al. | |
| 8,038,541 | B1 * | 10/2011 | Solomon | A63G 1/00 472/1 |
| 8,795,096 | B2 * | 8/2014 | Stoker | A63J 21/00 472/71 |

(Continued)

FOREIGN PATENT DOCUMENTS

| | | |
|---|---|---|
| CN | 207412704 | 5/2018 |
| WO | 2014113548 A1 | 7/2014 |

OTHER PUBLICATIONS

PCT/US2020/012433 International Search Report and Written Opinion dated Jun. 24, 2020.

*Primary Examiner* — Michael D Dennis
(74) *Attorney, Agent, or Firm* — Fletcher Yoder, P.C.

(57) ABSTRACT

Provided herein is a conveyor ride system that includes a conveyor structure having a plurality of conveyor beams and a plurality of conveyor grooves. The plurality of conveyor beams and the plurality of conveyor grooves are configured to direct a ride vehicle along a surface of the conveyor structure. The surface of the conveyor structure defines at least a portion of a ride path of the conveyor ride system.

20 Claims, 6 Drawing Sheets

(56) References Cited

U.S. PATENT DOCUMENTS

| | | | | |
|---|---|---|---|---|
| 8,943,975 | B2 * | 2/2015 | Gmeinwieser | A63G 7/00 104/53 |
| 9,266,028 | B2 | 2/2016 | Alfieri et al. | |
| 2002/0068640 | A1 | 6/2002 | Uemura et al. | |
| 2002/0103033 | A1 * | 8/2002 | Stengel | A63G 7/00 472/131 |
| 2007/0265103 | A1 * | 11/2007 | Roodenburg | A63G 31/02 472/43 |
| 2009/0126596 | A1 * | 5/2009 | Threlkel | A63G 21/04 104/75 |
| 2012/0006221 | A1 * | 1/2012 | Crawford | A63G 31/02 104/53 |
| 2012/0149479 | A1 * | 6/2012 | Nemeth | A63G 1/30 472/119 |
| 2013/0012327 | A1 * | 1/2013 | Schreibfeder | A63G 31/00 472/2 |
| 2014/0200087 | A1 * | 7/2014 | Vatcher | A63G 31/02 472/131 |
| 2015/0065260 | A1 * | 3/2015 | Beyr | A63G 31/16 472/60 |
| 2015/0114249 | A1 * | 4/2015 | Comorre | A63G 21/20 104/69 |
| 2015/0141161 | A1 * | 5/2015 | Alfieri | A63G 31/16 472/50 |
| 2016/0279529 | A1 | 9/2016 | Kitchen et al. | |
| 2017/0225084 | A1 * | 8/2017 | Snyder | A63G 7/00 |

* cited by examiner

CONVEYOR RIDE SYSTEM

CROSS REFERENCE TO RELATED APPLICATIONS

This application claims priority from and the benefit of U.S. Provisional Application Ser. No. 62/789,045, entitled "CONVEYOR RIDE SYSTEM," filed Jan. 7, 2019, which is hereby incorporated by reference in its entirety for all purposes.

BACKGROUND

The present disclosure relates generally to amusement park-style rides and, more specifically, to a conveyor ride system for an amusement park.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Amusement parks contain a variety of rides providing unique experiences to each park guest. In some cases, amusement park rides may generally include multi-passenger vehicles that travel along a fixed path, such as a track. In addition to the excitement created by the speed or change in direction of the vehicles as they move along the path, the vehicles themselves may generate special effects (e.g., sound and/or motion effects). Although a repeat rider may be familiar with the general path of the ride, the special effects may create interest during second and subsequent rides. In another example, certain rides may be implemented with projection elements to create varying scenery and movement as the passenger vehicles travel along the path. However, regardless of the enhancements to such passenger vehicle rides, the rider in the passenger vehicle may not feel immersed in the ride. With the increasing sophistication and complexity of modern attractions, and the corresponding increase in expectations among amusement park and/or theme park guests, improved and more creative attractions are needed.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a conveyor ride system includes a conveyor structure having a plurality of conveyor beams and a plurality of conveyor grooves. The plurality of conveyor beams and the plurality of conveyor grooves are configured to direct a ride vehicle along a surface of the conveyor structure. The surface of the conveyor structure defines at least a portion of a ride path of the conveyor ride system.

In another embodiment, a system includes a conveyor structure having a plurality of conveyor beams and a plurality of conveyor grooves. The plurality of conveyor beams is configured to direct a ride vehicle linearly along a surface of the conveyor structure. A segment of a conveyor beam of the plurality of conveyor beams is configured to direct the ride vehicle along a conveyor groove of the plurality of conveyor grooves in a circumferential direction about the conveyor structure.

In yet another embodiment, a ride system includes a ride vehicle having a base and a seat rotatably coupled to the base. A conveyor structure of the ride system includes a conveyor beam and a conveyor groove. The ride vehicle is configured to couple to the conveyor beam and the conveyor groove via a guide assembly. The guide assembly is configured to direct the ride vehicle along a surface of the conveyor structure via the conveyor beam and the conveyor groove, and wherein the surface of the conveyor structure defines a first portion of a ride path of the conveyor ride system. A track of the ride system defines a second portion of the ride path of the conveyor ride system. The ride vehicle is configured to transition from the conveyor structure to the track.

DRAWINGS

These and other features, aspects, and advantages of the present disclosure will become better understood when the following detailed description is read with reference to the accompanying drawings in which like characters represent like parts throughout the drawings, wherein.

Figure 5:
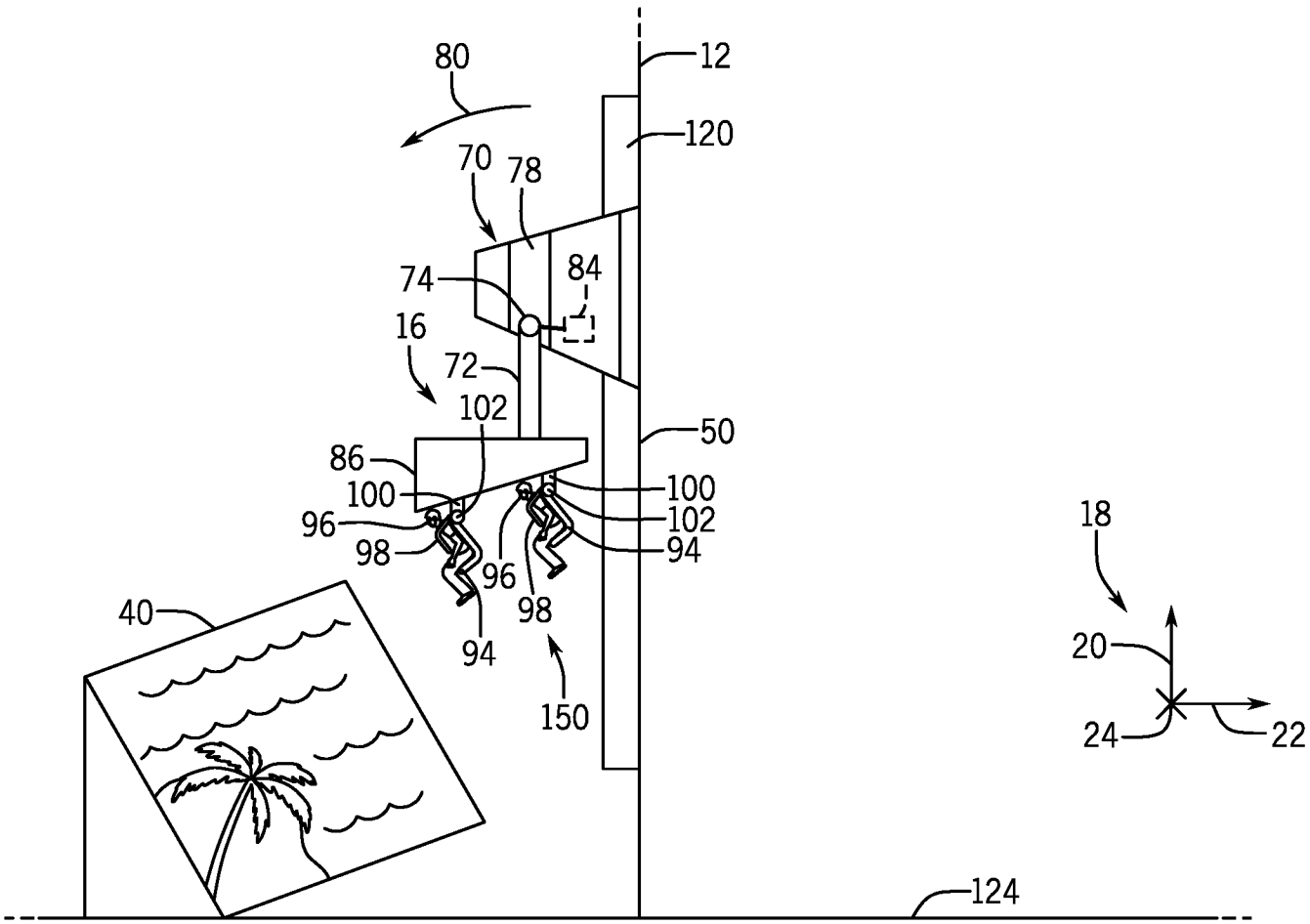
Figure 6:
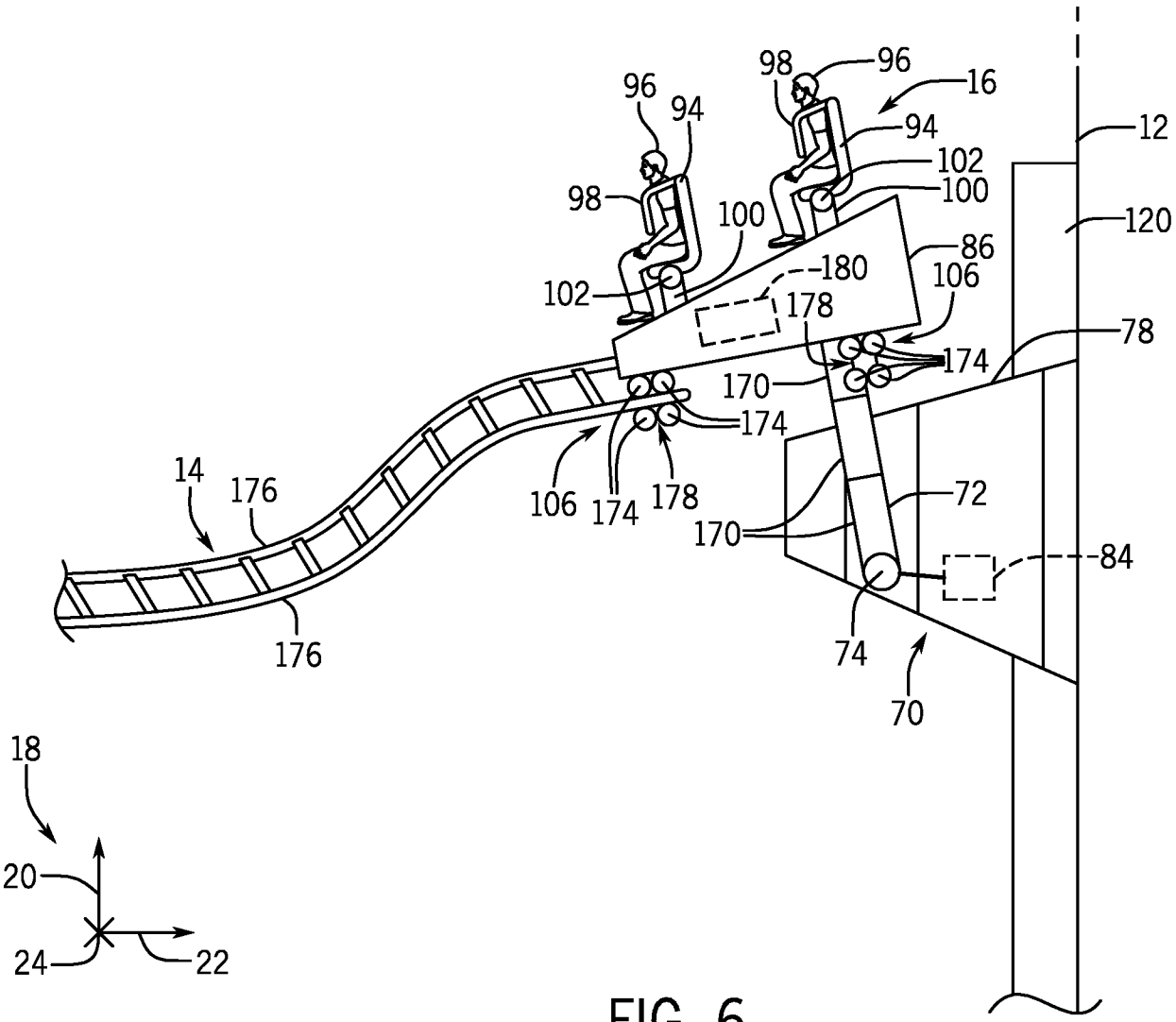

FIG. 5 is a schematic diagram of an embodiment of the conveyor ride system with the ride vehicle in a third position with respect to the conveyor structure, in accordance with aspects of the present disclosure; and FIG. 6 is a schematic diagram of an embodiment of the conveyor ride system with the ride vehicle transitioning from the conveyor structure to a track of the conveyor ride system, in accordance with aspects of the present disclosure.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

While the following discussion is generally provided in the context of amusement park rides that may include a conveyor ride system that enables enhanced degree of movement of a ride vehicle, it should be understood that the embodiments disclosed herein are not limited to such entertainment contexts. Indeed, the provision of examples and explanations in such an entertainment application is to facilitate explanation by providing instances of real-world implementations and applications. It should be appreciated that the embodiments disclosed herein may be useful in other applications, such as transportation systems (e.g., train systems), conveyer line systems, distribution systems, logistics systems, automation dynamic systems, and/or other industrial, commercial, and/or recreational systems, to name a few.

Amusement park rides may employ ride vehicles that carry passengers along a ride path, for example, defined by a track. Over the course of the ride, the ride path may include a number of features, including tunnels, turns, ascents, descents, loops, and so forth. The direction of travel of the ride vehicle may be defined by the ride path, as rollers of the ride vehicle may be in constant contact with the tracks defining the ride path. In this manner, ride passengers may anticipate these turns, eliminating excitement and thrill typically associated with amusement park rides. Accordingly, it is presently recognized that an amusement park ride having a conveyor system that enables movement in a plurality of directions and along multiple types of tracks may enhance an experience of a guest visiting the amusement park.

As such, embodiments of the present disclosure are directed to a conveyor ride system that includes a variety of features that enable movement of a passenger ride vehicle in a vertical direction, a circumferential direction, a lateral direction, a radial direction, and/or another suitable direction with respect to a conveyor structure. Further, the passenger ride vehicle is configured to transition between the conveyor structure and a track that may be separate from the conveyor structure. In some embodiments, the passenger ride vehicle may be configured to move via a guide assembly that directs the passenger ride vehicle along various features of the conveyor structure. Additionally or alternatively, the passenger ride vehicle is configured to rotate with respect to the guide assembly, and thus the ground, in order to utilize gravitational force as an additional element of the experience for the guests of the amusement park. Further still, the conveyor ride system may include visual elements disposed along a ride path of the conveyor ride system, such as display screens, holograms, show boxes, props, automated elements, tunnels, lighting changes, and/or other suitable visual elements that may enhance an experience of the guest.

Figure 1:
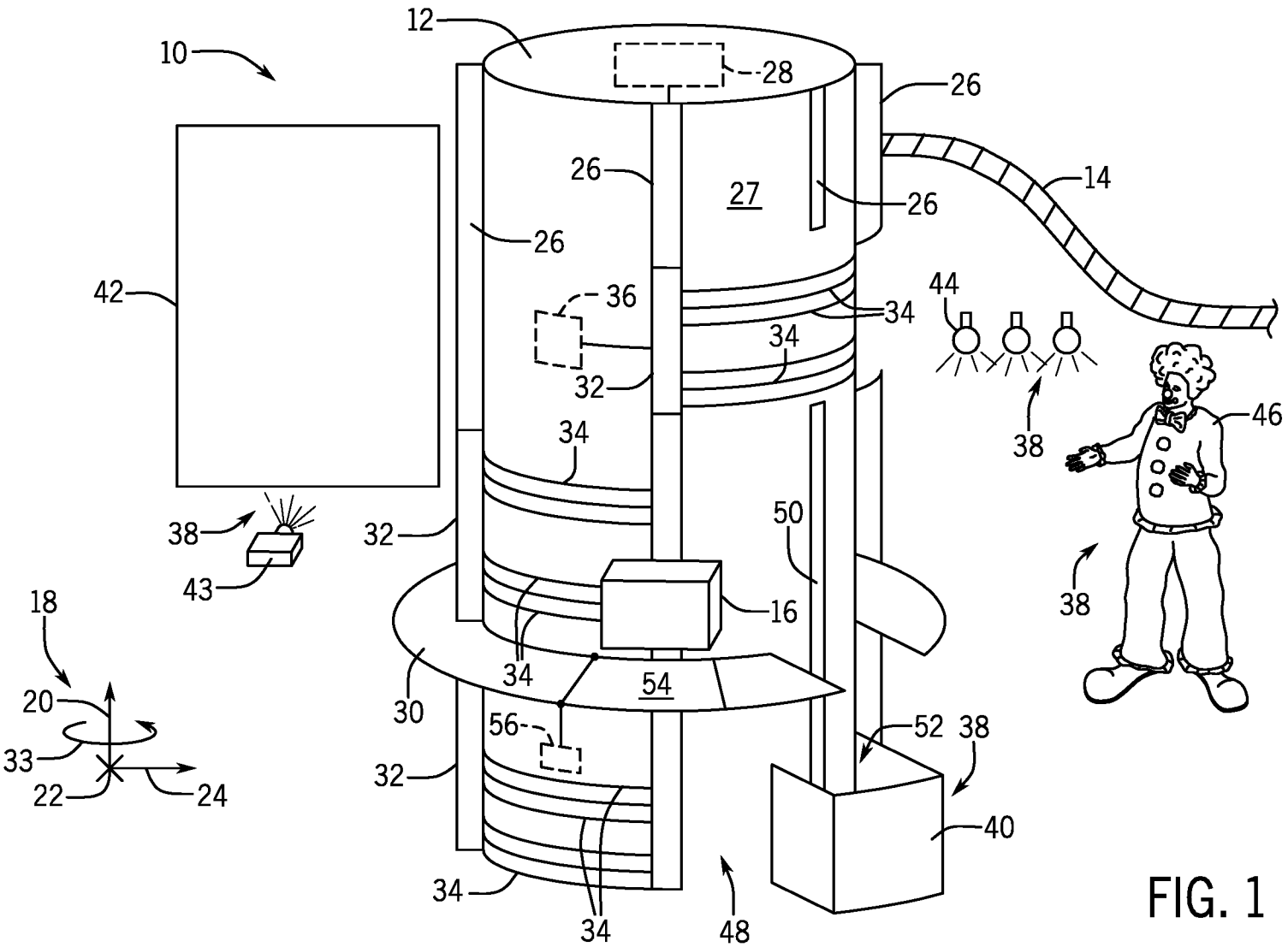
FIG. 1 is a schematic representation of an embodiment of a conveyor ride system that may enable vertical, circumferential, lateral, radial, or other forms of movement of a ride vehicle, in accordance with aspects of the present disclosure.

Turning to the drawings, FIG. 1 is a schematic of an embodiment of the conveyor ride system 10 having a conveyor structure 12 and a track 14, separate from the conveyor structure 12. As set forth above, a passenger ride vehicle 16 may be configured to transition from the conveyor structure 12 to the track 14 to provide guests with different sensations and experiences throughout a ride duration as the passenger ride vehicle 16 passes along a ride path of the conveyor ride system 10 that includes both the conveyor structure 12 and the track 14. Therefore, the conveyor ride system 10 may include a ride path having a first portion defined by movement generated by features of the conveyor structure 12 and a second portion defined by movement generated by the track 14 or features of the track 14. To facilitate discussion of movement of the passenger ride vehicle 16 throughout the conveyor ride system 10, a coordinate system 18 is provided and includes a vertical axis 20, a lateral axis 22, and a longitudinal axis 24, where the axes of the coordinate system 18 are orthogonal to one another. It should be noted that references to these axes should not be interpreted as adhering to strict mathematical relationships. For example, referencing movement along a particular axis may mean that the movement is generally in a direction of the axis (e.g., generally parallel to the axis).

In some embodiments, the conveyor structure 12 may include one or more conveyor beams 26 (e.g., extensions from a surface 27 of the conveyor structure) that direct the passenger ride vehicle 16 along the vertical axis 20. For example, the conveyor beams 26 may include belts, rollers, pulleys, magnets, or another suitable component coupled to an actuator 28 (e.g., a motor or other drive) that enables movement of the passenger ride vehicle 16 along the conveyor beams 26. In one embodiment, the passenger ride vehicle 16 may be coupled to the conveyor beams 26 via a guide system (see, e.g., FIG. 2) that may include bogies (e.g., wheel assemblies) that couple to and enable movement of the passenger ride vehicle 16 along the conveyor beams 26. As such, the conveyor beams 26 may act as a track or rail along which the bogies of the guide system move. Further, the conveyor beams 26 may be configured to move (e.g., via hydraulics, a motor, or another suitable drive system) along a track, groove, or other structure to direct movement of the passenger ride vehicle 16. Further still, the conveyor beams 26 may instead be grooves, tracks, rails, and/or other features that include a drive mechanism (e.g., gears, motors, pulleys, belts, rollers, magnets) that direct movement of the passenger ride vehicle 16 with respect to the conveyor structure 12.

In any case, the conveyor structure 12 may enable passengers within the passenger ride vehicle 16 to move vertically with respect to a platform 30 that surrounds, or at least partially surrounds, the conveyor structure 12. In other words, the passengers within the passenger ride vehicle 16 may be lifted upward with respect to the platform 30, such that the passengers may view objects and/or visual elements positioned further from the conveyor structure 12 and/or to experience an elevated height from the platform 30. Additionally or alternatively, the conveyor beams 26 (e.g., via conveyor belts on the conveyor beams 26, an actuator of the conveyor beams 26 themselves, and/or the bogies of the guide assembly of the passenger ride vehicle 16) may move the passenger ride vehicle 16 downwards toward the platform 30 at relatively high speeds, such that the passengers may believe that the passenger ride vehicle 16 is moving faster than speeds achieved by gravity. While the illustrated embodiment of FIG. 1 shows the conveyor structure 12 having four of the conveyor beams 26, it should be recognized that the conveyor structure 12 may have any suitable number of the conveyor beams 26 (e.g., one, two, three, five, six, seven, eight, nine, ten, or more than ten of the conveyor beams 26).

Further, the conveyor beams 26 may move with respect to the conveyor structure 12 to enable movement of the passenger ride vehicle 16. For instance, the conveyor beams 26 may include segments 32 that move the passenger ride vehicle 16 in a circumferential direction 33 about the conveyor structure 12, and thus, about the vertical axis 20. In other words, the segments 32 of the conveyor beams 26 may enable movement of the passenger ride vehicle 16 in a first direction with respect to the lateral axis 22 and a second direction with respect to the longitudinal axis 24 simultaneously. Therefore, a viewpoint of the passengers in the passenger ride vehicle 16 may be shifted with respect to an environment surrounding the passenger ride vehicle 16. As shown in the illustrated embodiment of FIG. 1, the segments 32 may be configured to move along grooves 34 (e.g., conveyor grooves, tracks, or guides) that are positioned along the conveyor structure 12. As used herein, the grooves 34 may include extensions (e.g., tracks or rails) extending from a surface of the conveyor structure 12, recesses (e.g., grooves or slots) disposed within the surface of the conveyor structure 12, or other suitable devices that guide movement of the segments 32 along the surface of the conveyor structure 12. For example, in one embodiment, the segments 32 be coupled to one or more gears that are positioned within the grooves 34. The gears may engage corresponding gears or a belt coupled to an actuator 36 (e.g., the actuator 28) that rotates the corresponding gears or the belt to drive movement of the segments 32 along the grooves 34. In other embodiments, the grooves 34 may include rollers, belts, pulleys, magnets, and/or another suitable device (e.g., coupled to the actuator 36) that may engage and/or otherwise enable movement of the segments 32 along the grooves 34.

While the illustrated embodiment of FIG. 1 shows the grooves 34 as being substantially crosswise to the vertical axis 20, in other embodiments, the grooves 34 may be angled with respect to the vertical axis 20, such that the grooves 34 also enable movement of the segments 32, and thus the passenger vehicle 16, along the vertical axis 20. Further, as shown in the illustrated embodiment, the segments 32 and the grooves 34 of the conveyor structure 12 may be positioned at various positions along the vertical axis 20 to enable movement of the passenger ride vehicle 16 in the circumferential direction 33 about the conveyor structure 12 at a variety of positions along the vertical axis 20. Further still, while the segments 32 illustrated in FIG. 1 are shown as a single portion of the conveyor beams 26, in other embodiments, the segments 32 may include multiple segments 32 that enable movement of the passenger ride vehicle 12 in the circumferential direction 33. Further, the segments 32 may be configured to travel across the grooves 34 or skip over certain grooves 34 to modify the ride path of the conveyor ride system 10. While the present discussion focuses on the grooves 34 directing movement of the passenger ride vehicle 16 in the circumferential direction 33 about the conveyor structure 12, it should be recognized that in other embodiments, extensions, beams, tracks, rails, or other similar features may be utilized to move the passenger ride vehicle 16 in the circumferential direction 33.

As described above, the conveyor beams 26 and/or the segments 32 of the conveyor beams 26 may shift a viewpoint of the passengers within the passenger ride vehicle 16 to enable the passengers to view a plurality of visual elements 38. For instance, as shown in the illustrated embodiment of FIG. 1, the conveyor ride system 10 includes a show box 40, a display screen 42 and a projector 43, a lighting arrangement 44, and an automated FIG. 46 as examples of the visual elements 38 that may be included in the conveyor ride system 10. It should be recognized that other visual elements 38 in addition to those illustrated in FIG. 1 may also be included to further enhance an experience of the passengers in the passenger ride vehicle 16. Similarly, fewer visual elements 38 than those shown in FIG. 1 may also be included in the conveyor ride system 10. As the passenger ride vehicle 16 is directed along the ride path of the conveyor ride system 10, the passengers within the ride vehicle may encounter a variety of visual experiences that may each generate various sensations and reactions from the passengers in combination with motions of the passenger ride vehicle 16.

As used herein, the show box 40 may include a feature that includes any suitable shape (e.g., a box, a tunnel, a prism) and has various components and elements that generate a scene or environment. The passenger ride vehicle 16 may be configured to enter and exit the show box 40 via an opening, a passageway, a door, or another suitable device to enable the passengers in the passenger ride vehicle to view the scene or environment created by the show box 40. The show box 40 may be positioned at a bottom portion 48 of the conveyor structure 12. In some embodiments, the passenger ride vehicle 16 may be lowered into the show box 40 by a conveyor beam 50 of the conveyor beams 26. As such, the passengers within the passenger ride vehicle 16 may be immersed into a simulated environment that is generated by features included in the show box 40. The show box 40 may include props, structural features, actors, automated characters, and/or other suitable features that may create a scene or invoke a particular setting that matches a theme of the conveyor ride system 10. Additional details of the show box 40 are described herein with reference to FIG. 5.

The display screen 42 may be positioned at another location along the ride path and/or the conveyor structure 12 than the show box 40. As such, when the passenger ride vehicle 16 is directed in the circumferential direction 33 and away from the conveyor beam 50 associated with the show box 40, a viewpoint of the passengers may be directed toward the display screen 42. The projector 43 may be configured to display two-dimensional and/or three-dimensional videos (e.g., videos that generate an illusion or perception of three-dimensional scenes when users wear a specific form of glasses or goggles) and/or images on the display screen 42 to further enable the passengers to view imagery that may be difficult to generate or otherwise show in the show box or through other features included in the conveyor ride system 10. For instance, a theme of at least a portion the conveyor ride system 10 may be related to the ocean. Therefore, the display screen 42 may be utilized to provide a visual experience that enables the passengers to believe that the passenger ride vehicle 16 has been immersed under water to view fish, coral, sunken treasure, or other objects or organisms that may be found in the ocean.

Further, the lighting arrangement 44 may be utilized to light up props that may otherwise be hidden from a view of the passengers when the lighting arrangement 44 is not illuminated. For instance, in some embodiments, the lighting arrangement 44 may illuminate the automated FIG. 46, such that the automated figure is visible to the passengers when the passenger ride vehicle 16 is at a target position along the ride path of the conveyor ride system 10. When the lighting arrangement 44 is off (e.g., not illuminated), the automated FIG. 46 may be difficult to view and/or may be completely hidden from the view of the passengers. In some embodiments, the automated FIG. 46 may be actuated to move (e.g., wave and/or move towards the passenger ride vehicle 16) as the lighting arrangement 44 is illuminated, such that it appears to the passengers that the automated FIG. 46 is a living creature or being. In other embodiments, the lighting arrangement 44 may be configured to illuminate and provide a light show or effect (e.g., strobe) to invoke various senses of the passengers in the passenger vehicle 16. In still further embodiments, the lighting arrangement may be configured to illuminate other visual elements 38 that are not illustrated in the embodiment of FIG. 1.

As discussed above, the conveyor structure 12 includes a platform 30 that at least partially surrounds the conveyor structure 12. As shown in the illustrated embodiment of FIG. 1, the platform 30 may include an opening 52 that enables the passenger ride vehicle 16 to pass through the platform 30 and to be positioned within or proximate to the show box 40. Further, the passenger ride vehicle 16 may be configured to move underneath the platform 30 with respect to the vertical axis 20 via a door 54 or the opening 52. For instance, the platform 30 may include the door 54 (e.g., a gate or other barrier that may open and close), which may enable the passenger ride vehicle 16 to temporarily pass through the platform 30. As such, the door 54 may be controlled by an actuator 56 that is timed to open and close the door 54 as the passenger ride vehicle 16 approaches the platform 30 and after the passenger ride vehicle 16 completely passes through the platform 30, respectively. In other embodiments, the door 54 may be opened by movement of the passenger ride vehicle 16 (e.g., when the passenger ride vehicle 16 includes a barrier covering the passengers). In such embodiments, the door 54 may be configured to close automatically via gravity and/or be closed via the actuator 56. In any case, the door 54 may provide a sense of excitement to the passengers by creating an illusion that the passenger ride vehicle 16 is going to crash or otherwise contact the platform 30.

In some embodiments, the platform 30 may include decorations, physical features, props, paint, or other suitable visual elements that may be consistent with the theme of the conveyor ride system 10. Accordingly, the platform 30 may be utilized as another visual element 38 that further enhances an experience of the passengers within the passenger ride vehicle 16. It should be noted that while the conveyor structure 12 illustrated in FIG. 1 includes a generally cylindrical shape, the conveyor structure 12 may be a wall or a series of walls, a box shape, a rectangular prism, another prismatic shape, or any suitable shape that enables the passenger ride vehicle 16 to move along any suitable combination of the vertical axis 20, the lateral axis, and the longitudinal axis 24. Further still, the conveyor structure 12 may include any suitable configuration for enabling linear movement (e.g., movement in a straight line) and/or circumferential movement (e.g., movement along one or more arcs) of the passenger ride vehicle 16. Additionally or alternatively, the conveyor structure 12 may include an annular shape (e.g., ring-shaped) that enables the actuators 28, 36, 56 and/or other components of the conveyor ride system 10 to be positioned within the conveyor structure 12.

Figure 2:
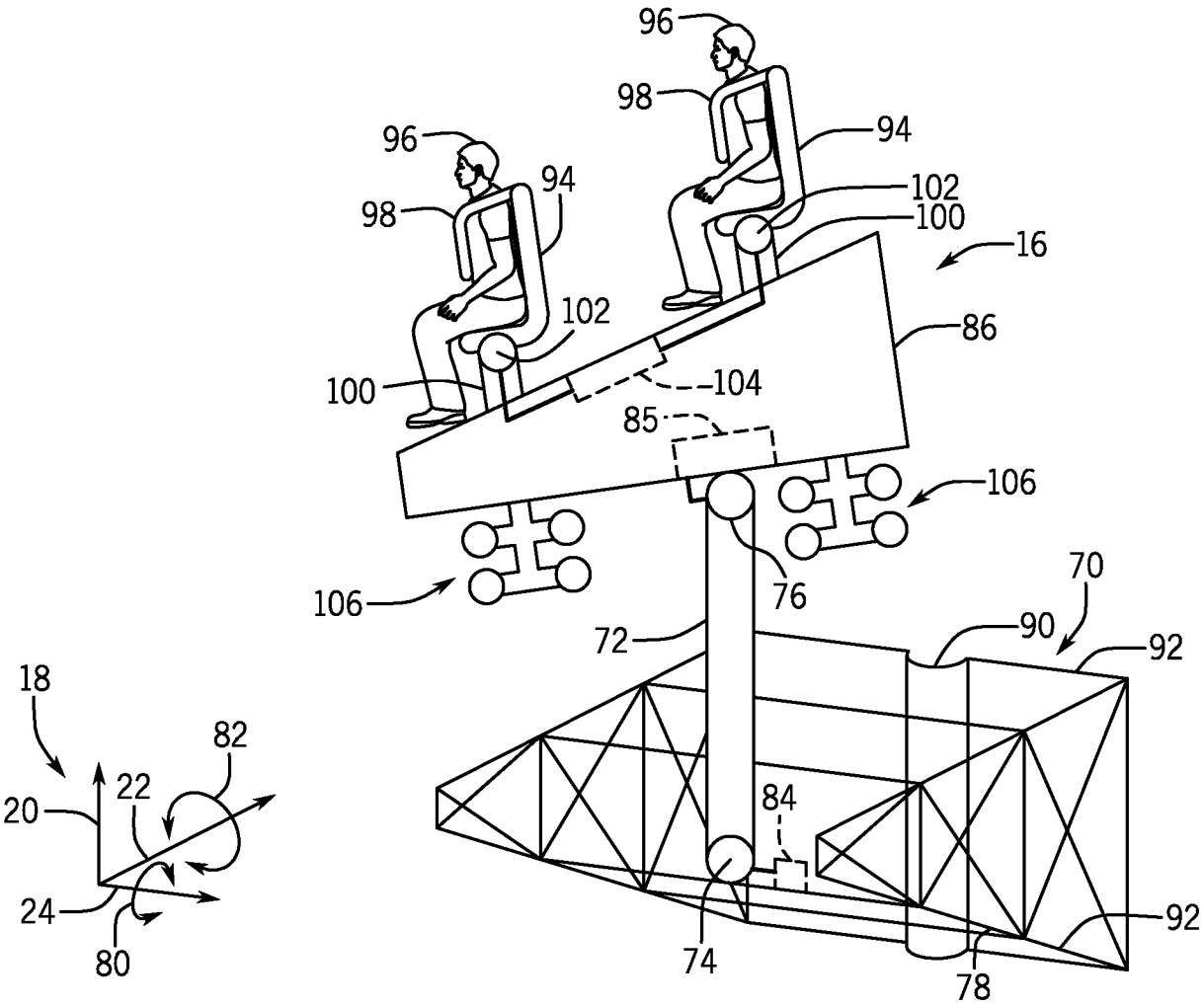
FIG. 2 is a perspective view of an embodiment of the ride vehicle and a guide assembly for directing the ride vehicle along at least a portion of a ride path of the conveyor ride system, in accordance with aspects of the present disclosure.

FIG. 2 is a schematic representation of an embodiment of the passenger vehicle 16 coupled to a guide assembly 70 that is configured to travel along the conveyor beams 26 as well as the grooves 34. As discussed above, the conveyor beams 26 may include extensions from a surface of the conveyor structure 12, conveyor grooves, tracks, rails, or any other suitable feature that guides or otherwise directs movement of the passenger ride vehicle 16 along the surface of the conveyor structure 12. Similarly, the grooves 34 may include recesses in the surface of the conveyor structure 12 that couple the segments 32 of the conveyor beams 26 to a track, a conveyor, a belt, a pulley assembly, or another suitable feature for moving the segments 32 along the surface of the conveyor structure 12. In other embodiments, the grooves 34 may also include extensions from the surface of the conveyor structure 12, conveyor grooves, tracks, rails, or other suitable features that guide or otherwise direct movement of the passenger ride vehicle 16.

As shown in the illustrated embodiment of FIG. 2, the passenger ride vehicle 16 is rotatably coupled to the guide 70 via a support 72 at a first joint 74 of the guide assembly 70 and a second joint 76 of the passenger ride vehicle 16. The guide assembly 70 may include a frame structure 78 having a configuration that allows rotation of the passenger ride vehicle 16 about the lateral axis 22 and/or the longitudinal axis 24 without obstruction. Further, the frame structure 78 couples the passenger ride vehicle 16 to the conveyor structure 12 (e.g., the conveyor beams 26, the segments 32, and/or the grooves 34). For instance, the first joint 74 may enable rotation of the support 72 with respect to the frame structure 78 of the guide assembly 70 in a circumferential direction 80 about the longitudinal axis 24 and/or in a circumferential direction 82 about the lateral axis 22. As such, the frame structure 78 of the guide assembly 70 may include an actuator 84 (e.g., a motor) that adjusts a position of the support 72 via the first joint 74. Further still, an additional actuator 85 (e.g., a motor) may direct rotation of the passenger ride vehicle 16 about the second joint 76 with respect to the support 72 and/or the frame structure 78. The additional actuator 85 may enable rotation of the passenger vehicle 16 about the second joint 76 with respect to the support 72 in the circumferential direction 80 about the longitudinal axis 24 and/or in the circumferential direction 82 about the lateral axis 22. In some embodiments, the additional actuator 85 (e.g., a motor) may be housed or otherwise disposed in a body 86 of the passenger ride vehicle 16. Additionally or alternatively, the support 72 may enable linear actuation of the passenger ride vehicle 16 with respect to the frame structure 78 and/or the conveyor structure 12. For instance, as described below, the support 72 may include telescoping segments that direct the passenger ride vehicle 16 linearly toward and away from the frame structure 78.

The guide assembly 70 may further include a conveyor beam guide 90 and a groove guide 92 to couple the frame structure 78 to the conveyor beams 26 and/or the grooves 34. For instance, the conveyor beam guide 90 (e.g., a bogie assembly) and/or the groove guide 92 (e.g., a bogie assembly) may include securement features such as hooks, wheels, clamps, latches, couplers, ties, and/or other suitable features that enable the conveyor beam guide 90 and/or the groove guide 92 to couple to an interface of the conveyor beams 26 and/or the grooves 34, respectively. The conveyor beam guide 90 may then enable movement of the guide assembly 70 and the passenger ride vehicle 16 along the vertical axis 20 as the actuator 28 controls the belts, rollers, pulleys, magnets, or other suitable components to direct the guide assembly 70 along the conveyor beams 26. Further, the groove guide 92 may enable movement of the guide assembly 70 and the passenger ride vehicle 16 in the circumferential direction 33 about the conveyor structure 12 as the actuator 36 controls the belts, rollers, pulleys, magnets, or other suitable components to direct the guide assembly 70 along the grooves 34.

As shown in the illustrated embodiment of FIG. 2, the passenger ride vehicle 16 includes seats 94 for passengers 96 experiencing the conveyor ride system 10. The seats 94 may include restraints 98 (e.g., shoulder restraints) that secure the passengers 96 in the seats 94 as the passenger ride vehicle 16 moves, rotates, and is otherwise manipulated throughout the duration of operation of the conveyor ride system 10. In some embodiments, the seats 94 may be coupled to the body 86 of the passenger ride vehicle 16 via a respective base 100 and a respective joint 102. The joint 102 may enable rotation of the seats 94 with respect to the body 86 of the passenger ride vehicle 16 and/or the base 100. For instance, an actuator 104 (e.g., motor) may be coupled to each joint 102 to adjust a position of a respective seat 94. In some embodiments, the seats 94 may be configured to maintain a position of the passengers 96 with respect to the platform 30 (or the ground) as the passenger ride vehicle 16 moves and/or rotates throughout the duration of the conveyor ride system 10. Additionally or alternatively, the seats 94 may be rotated independently of body 86 of the passenger ride vehicle 16. Further still, the seats 94 may be linearly actuated from the body 86 of the passenger ride vehicle 16. For instance, each base 100 may include telescoping segments coupled to the actuator 104, and thus, enable the seats 94 to move toward and away from the body 86 of the passenger ride vehicle 16.

The passenger ride vehicle 16 may also include bogie assemblies 106 that enable the passenger ride vehicle 16 to transition from the guide assembly 70 to the track 14. As such, the support 72 may be configured to decouple from the body 86 of the passenger ride vehicle 16, thereby enabling the passenger ride vehicle 16 to move along the track 14 via the bogie assemblies 106. The transition between the guide assembly 70 and the bogie assemblies 106 is discussed in further detail herein with reference to FIG. 6.

Figure 3:
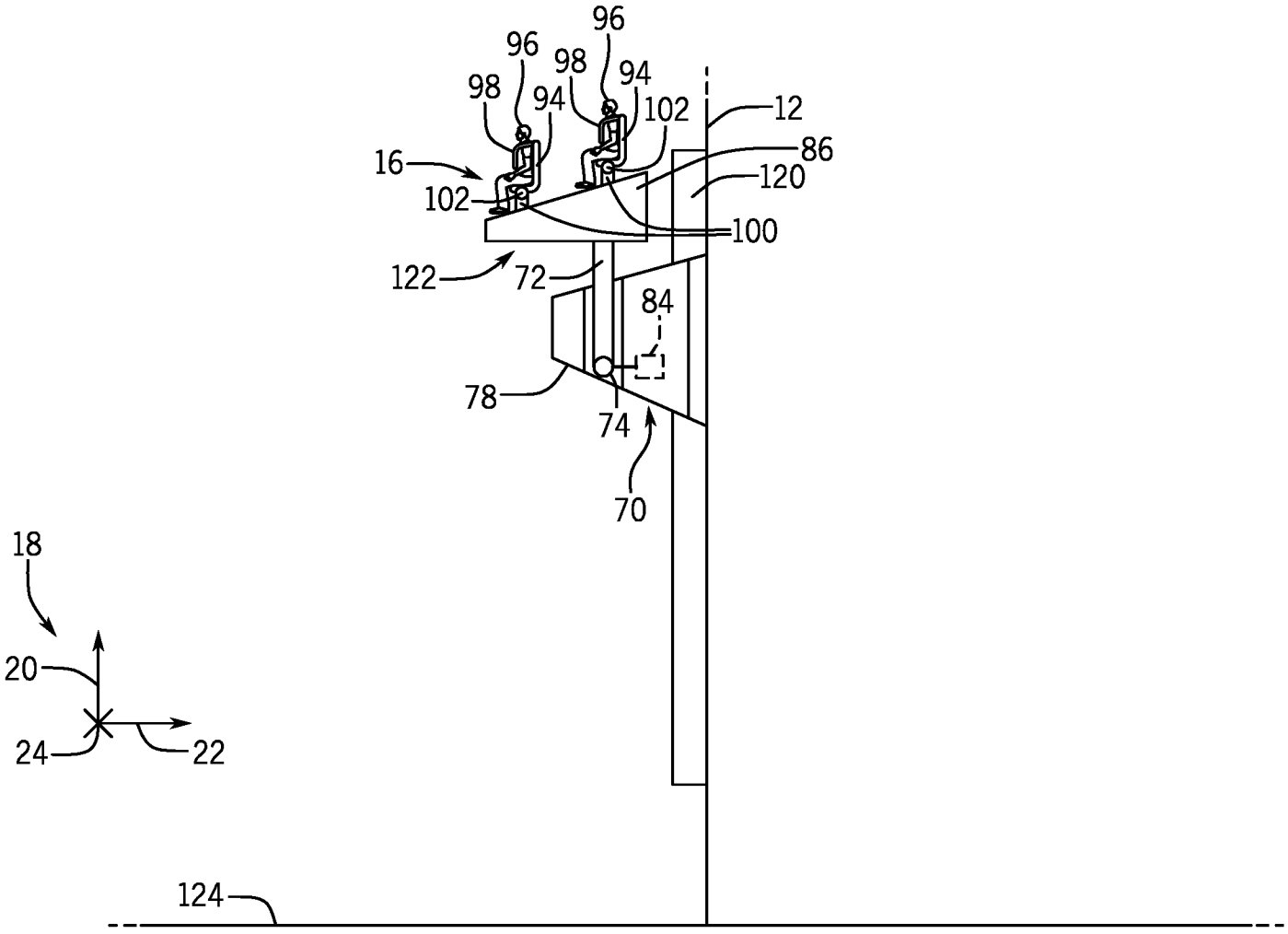
FIG. 3 is a schematic diagram of an embodiment of the conveyor ride system with a ride vehicle in a first position with respect to a conveyor structure of the conveyor ride system, in accordance with aspects of the present disclosure.

FIG. 3 is a schematic representation of an embodiment of the guide assembly 70 coupled to a conveyor beam 120 of the conveyor beams 26, where the passenger ride vehicle 16 is in a first position 122. As shown in the illustrated embodiment of FIG. 3, the support 72 is generally parallel to the vertical axis 20 and/or the conveyor beam 120. As such, the body 86 of the passenger ride vehicle 16 is generally crosswise to the vertical axis 20 and/or generally parallel to the lateral axis 22. In some embodiments, the seats 94 of the passenger ride vehicle 16 are configured to position the passengers 96 in an upright position that enables the passengers 96 to have a viewpoint along a sight path that is generally parallel to the ground 124. In other embodiments, the seats 94 of the passenger ride vehicle 16 may be adjusted at the respective joints 102, such that the position of the passengers 96 is different from that shown in the illustrated embodiment of FIG. 3. As the guide assembly 70 moves along the conveyor beam 120 and/or other conveyor beams 26, the position of the support 72 may be adjusted to change a viewpoint of the passengers 96 and/or to provide the passengers 96 with varying sensations.

Figure 4:
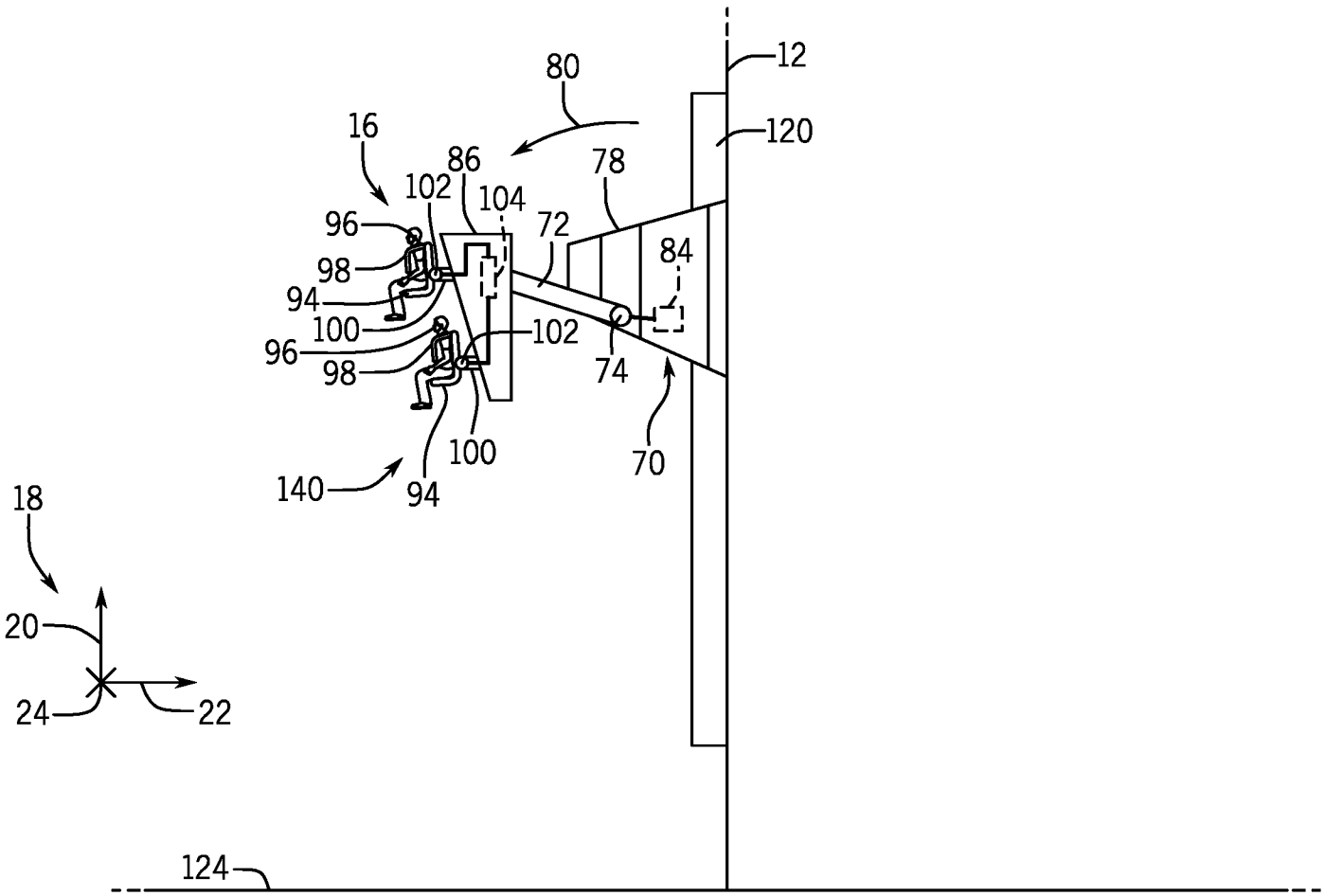
FIG. 4 is a schematic diagram of an embodiment of the conveyor ride system with the ride vehicle in a second position with respect to the conveyor structure, in accordance with aspects of the present disclosure.

For example, FIG. 4 is a schematic of an embodiment of the guide assembly 70 coupled to the conveyor beam 120, where the passenger ride vehicle 16 is in a second position 140. As shown in the illustrated embodiment of FIG. 4, the support 72 has rotated in the circumferential direction 80 about the longitudinal axis 24 from the first position 122 (see FIG. 3) to the second position 140. For instance, the actuator 84 may be configured to drive rotation of the support 72 with respect to the guide assembly 70, thereby changing a position of the passenger ride vehicle 16 with respect to the guide assembly 70. When in the second position 140, the body 86 of the passenger ride vehicle 16 is generally parallel to the vertical axis 20 and/or the conveyor beam 120, although other arrangements of the body 86 may be employed in accordance with present embodiments. In some embodiments, the seats 94 of the passenger ride vehicle 16 rotate with respect to the body 86 of the passenger ride vehicle 16. For example, the actuator 104 may rotate the seats 94 about the respective bases 100, such that a position of the passengers 96 is maintained in the upright position (e.g., generally parallel with the ground 124). In other embodiments, the actuator 104 may adjust a position of the seats 94 to another suitable position. In still further embodiments, a position of the seats 94 when the passenger ride vehicle 16 is in the first position 122 may be maintained when in the second position 140. The position of the seats 94 may be adjusted to any suitable position when the passenger ride vehicle 16 transitions to, or is maintained in, any given position.

FIG. 5 is a schematic of an embodiment of the guide assembly 70 coupled to the conveyor beam 120, where the passenger ride vehicle 16 is in a third position 150. When in the third position 150, the body 86 of the passenger ride vehicle 16 is generally parallel to the ground 124, but rotated approximately (e.g., within 10% of, within 5% of, or within 1% of) 180 degrees from the first position 122 (see, e.g., FIG. 3). As such, the passengers 96 are generally suspended from the body 86 of the passenger ride vehicle 16 via the base 100 of the respective seats 94. As shown in the illustrated embodiment of FIG. 5, the seats 94 are further rotated about the circumferential direction 80 from the position shown in FIG. 4 to substantially maintain the passengers 96 in the upright position as the passenger ride vehicle 16 rotates about the guide assembly 70. In other embodiments, the seats 94 may not rotate, such that the passengers 96 are in an inverted or upside down position with respect to the ground 124. In other embodiments, seats 94 may be in any position that places the passengers 96 in any suitable position with respect to the ground 124 and other components of the conveyor ride system 10.

It should be recognized that the passenger ride vehicle 16 may be in any position between the first position 122 (see FIG. 3), the second position 140 (see FIG. 4), and/or the third position 150. Further, the passenger ride vehicle 16 may be positioned beyond the first position 122 and/or the third position 150 with respect to the circumferential direction 80. For instance, in some embodiments, the passenger ride vehicle 16 may be rotated beyond the first position 122 and/or the third position 150 to contact the conveyor structure 12 and create the illusion or impression that the passenger ride vehicle 16 has crashed or otherwise run into the conveyor structure 12.

As shown in the illustrated embodiment of FIG. 5, the passengers 96 may be positioned proximate to the show box 40 when in the third position 150. For instance, the position of the passenger ride vehicle 16 may be adjusted in order to enable the passengers 96 to be within, or close to, the show box 40 to enable the passengers 96 to perceive the scene in which the show box 40 conveys. In some embodiments, rotational features alone or in combination with other actuators (e.g., telescoping linear actuators) may be used to position the passenger ride vehicle 16 in the show box 40. In one embodiment, the guide assembly 70 may move downward along the vertical axis 20 with respect to the ground 124 to lower the passengers 96 into the show box 40. As such, components (e.g., actuated figures, objects, screens, actors, holograms, or other features) may act out a scene that may be viewed by the passengers 96, who are positioned proximate to the components. When the scene of the show box 40 is complete, the guide assembly 70 may move the passenger ride vehicle 16 upward along the vertical axis 20 to continue along the ride path of the conveyor ride system 10. In some embodiments, movement of the passenger ride vehicle 16 may be associated with the scene created by the show box 40. For example, the show box 40 may create a scene that includes a blast or other forceful phenomena, which may create an illusion that the passenger ride vehicle 16 is moving as a result of the blast or other forceful phenomena. In any case, movement of the passenger ride vehicle 16 (e.g., along the conveyor beams 26, along the grooves 34, and/or about the guide assembly 70) may further enhance an experience of the passengers 96 throughout a duration of the conveyor ride assembly 10.

In some embodiments, the scene or other features within the show box 40 may not be positioned in a typical arrangement that would occur as a result of gravity (e.g., the scene or features may be inverted with respect to gravity). For example, some of the features within the show box 40 may be coupled or secured to walls (e.g., a floor, a ceiling, sidewalls) of the show box 40 in a manner that creates a perception that such items are sideways, upside down, or otherwise misplaced (e.g., inverted) to a user standing on the ground 124. However, the passengers 96 within the ride vehicle 16 may be positioned within the show box 40 via the guide assembly 70, the support 72, the seats 94, and/or other features of the conveyor ride system 10, such that the passengers 96 view the scene produced within the show box 40 in a normal manner (e.g., the features appear upright or in conformance with gravity to the passengers 96). However, the passengers 96 may also feel the force of gravity acting in a direction that is counter to what the passengers 96 expect or would typically experience. For example, the passengers 96 may be positioned sideways or upside down with respect to the ground 124 but otherwise perceive the scene in the show box 40 as normal. Accordingly, the show box 40 may be utilized to create unusual sensations that obscure the perceptions of the passengers 96.

As discussed above, the passenger ride vehicle 16 may transition from the guide assembly 70 to the track 14, which may also lead to enhancing an experience of the passengers 96. For instance, FIG. 6 is a schematic of an embodiment of the passenger ride vehicle 16 transitioning from the guide assembly 70 to the track 14. As shown in the illustrated embodiment, the support 72 is coupled to the body 86 of the passenger ride vehicle 16. However, once the passenger ride vehicle 16 is secured to the track 14, the support 72 may be disconnected from the body 86 of the passenger ride vehicle 16. In some embodiments, the support 72 may include telescoping rods 170 that enable the support 72 to extend or retract with respect to the guide assembly 70. As such, the telescoping rods 72 may facilitate coupling the passenger ride vehicle 16 to the track 14 by providing another degree of movement between the support 72, the guide assembly 70, and the track 14. In still further embodiments, the support 72 may be configured to disconnect from the guide assembly 70 rather than the passenger ride vehicle 16. The support 72 may be configured to extend outward from, and retract into, the body 86 of the passenger ride vehicle 16. As such, the support 72 may be integrated with the passenger ride vehicle 16 instead of the guide assembly 70. In one embodiment, the support 72 does not obstruct or restrict movement of the passenger ride vehicle 16 when the passenger ride vehicle 16 is positioned on the track 14.

As shown in the illustrated embodiment of FIG. 6, the passenger ride vehicle 16 includes the bogie assemblies 106 that include wheels 174 configured to move along rails 176 of the track 14. In some embodiments, the bogie assemblies 106 may be positioned within the body 86 of the passenger ride vehicle 16 when the passenger ride vehicle 16 is coupled to and moving with the guide assembly 70. When the passenger ride vehicle 16 transitions to the track 14, the bogie assemblies 106 may extend outward from the body 86 of the passenger ride vehicle 16 to engage the track 14. As such, the bogie assemblies 106 may not limit movement of the passenger ride vehicle 16 with respect to the guide assembly 70 and/or the conveyor structure 12.

To position the wheels 174 of the bogie assemblies 106 onto the rails 176, the passenger ride vehicle 16 may be moved toward the track 14 by the support 72 to enable the wheels 174 to slide onto the rails 176. In some embodiments, the bogie assemblies 106 may include a clamping mechanism 178 that enables vertically adjacent wheels 174 to move toward and away from one another. Accordingly, the wheels 174 may be separated from one another to facilitate sliding of the wheels 174 onto the rails 176. When the wheels 174 are positioned onto the rails 176, the clamping mechanism 178 may move the wheels 174 toward one another to secure the passenger ride vehicle 16 to the track 14. The passenger ride vehicle 16 may include a motor 180 that is coupled to the wheels 174 to direct movement along the track 14. In other embodiments, the passenger ride vehicle 16 may move along the track 14 using any suitable drive mechanism (e.g., pulleys, motors, conveyors, magnets).

Similarly, to remove the passenger ride vehicle 16 from the track 14, the support 72 may be recoupled to the body 86 of the passenger ride vehicle 16 or extended from the body 86 of the passenger ride vehicle 16 toward the guide assembly 70. The support 72 may then slide the wheels 174 off of the rails 176 to enable the passenger ride vehicle to move with the guide assembly 70. The bogie assemblies 106 may retract into the body 86 of the passenger ride vehicle 16 to avoid any potential obstruction when the passenger ride vehicle 16 moves along the conveyor structure 12 via the guide assembly 70. Accordingly, the passenger ride vehicle 16 may transition between movement directed by the guide assembly 70 along the conveyor structure 12 and movement directed by the track 14 to provide multiple types of experiences for the passengers 96.

While the illustrated embodiments of the conveyor ride system 10 each show a single passenger ride vehicle 16, it should be recognized that the conveyor ride system 10 may include a plurality of passenger ride vehicles 16 that move in succession along the ride path (or along different ride paths) of the conveyor ride system. Indeed, the conveyor ride system 10 may include two, three, four, five, six, seven, eight, nine, ten, or more than ten of the passenger ride vehicles 16.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A conveyor ride system, comprising:

a ride vehicle; and a conveyor structure comprising a plurality of conveyor beams and a plurality of conveyor grooves, wherein the plurality of conveyor beams and the plurality of conveyor grooves are configured to direct the ride vehicle along a surface of the conveyor structure, wherein the surface of the conveyor structure defines at least a portion of a ride path of the conveyor ride system, wherein the plurality of conveyor beams is configured to direct the ride vehicle linearly, circumferentially, or both, along the surface of the conveyor structure, and wherein a segment of a conveyor beam of the plurality of conveyor beams is configured to move along a conveyor groove of the plurality of conveyor grooves in a circumferential direction, a linear direction, or both, about the conveyor structure.

2. The conveyor ride system of claim 1, wherein the ride vehicle is coupled to the conveyor structure via a guide assembly, the guide assembly comprising a frame structure and a support.

3. The conveyor ride system of claim 2, wherein the support is rotatably coupled to the frame structure and coupled to the ride vehicle, such that the ride vehicle is configured to rotate in a circumferential direction with respect to the guide assembly.

4. The conveyor ride system of claim 1, wherein the ride vehicle comprises a plurality of seats secured to a body of the ride vehicle.

5. The conveyor ride system of claim 4, wherein each seat of the plurality of seats is rotatably coupled to respective bases coupled to the body of the ride vehicle.

6. The conveyor ride system of claim 5, comprising an actuator configured to adjust a position of the plurality of seats to maintain a position of passengers in the ride vehicle in an upright position with respect to ground.

7. The conveyor ride system of claim 1, comprising a track defining an additional portion of the ride path of the conveyor ride system, wherein the track is configured to direct movement of the ride vehicle, and wherein the ride vehicle is configured to transition from the conveyor structure to the track.

8. The conveyor ride system of claim 7, wherein the ride vehicle comprises a bogie assembly configured to couple the ride vehicle to the track.

9. The conveyor ride system of claim 8, wherein the bogie assembly comprises wheels configured to clamp against a rail of the track.

10. The conveyor ride system of claim 8, wherein the bogie assembly is configured to extend from the body of the ride vehicle when the ride vehicle transitions from the conveyor structure to the track.

11. The system of claim 1, wherein the conveyor structure comprises a generally cylindrical shape.

12. The system of claim 1, comprising a show box positioned along at least the portion of the ride path of the conveyor ride system, wherein the show box is configured to generate a simulated environment, and wherein the plurality of conveyor beams, the plurality of conveyor grooves, or both, is configured to position the ride vehicle proximate to the show box.

13. A system, comprising:

a conveyor structure comprising a plurality of conveyor beams and a plurality of conveyor grooves, wherein the plurality of conveyor beams is configured to direct a ride vehicle linearly along a surface of the conveyor structure, and wherein a segment of a conveyor beam of the plurality of conveyor beams is configured to direct the ride vehicle along a conveyor groove of the plurality of conveyor grooves in a circumferential direction about the conveyor structure.

14. The system of claim 13, comprising the ride vehicle, wherein the ride vehicle is configured to couple to a conveyor beam of the plurality of conveyor beams via a bogie assembly to drive movement of the ride vehicle linearly along the surface of the conveyor structure.

15. The system of claim 14, comprising an actuator configured to drive movement of the bogie assembly.

16. The system of claim 13, comprising a track configured to receive the ride vehicle from the conveyor structure.

17. The system of claim 13, comprising the ride vehicle, wherein the ride vehicle is configured to couple to a conveyor beam of the plurality of conveyor beams via a bogie assembly to drive movement of the ride vehicle circumferentially along the surface of the conveyor structure.

18. A ride system, comprising:

a ride vehicle comprising a base and a seat rotatably coupled to the base;

a conveyor structure comprising a conveyor beam and a conveyor groove, wherein the ride vehicle is configured to couple to the conveyor beam and the conveyor groove via a guide assembly, wherein the guide assembly is configured to direct the ride vehicle along a surface of the conveyor structure via the conveyor beam and the conveyor groove, and wherein the surface of the conveyor structure defines a first portion of a ride path of the conveyor ride system; and a track defining a second portion of the ride path of the conveyor ride system, wherein the ride vehicle is configured to transition from the conveyor structure to the track, wherein the conveyor beam is configured to direct the ride vehicle linearly, circumferentially, or both, along the surface of the conveyor structure, and wherein a segment of the conveyor beam is configured to move along the conveyor groove in a circumferential direction, a linear direction, or both, about the conveyor structure.

19. The ride system of claim 18, comprising a show box positioned along the first portion of the ride path of the conveyor ride system, wherein the show box is configured to generate a simulated environment, and wherein the plurality of conveyor beams, the plurality of conveyor grooves, or both, is configured to position the ride vehicle proximate to the show box.

20. The system of claim 19, wherein the simulated environment generated by the show box comprises features secured to walls of the show box in an inverted position with respect to gravity.

* * * * *